US010760564B2

(12) United States Patent
Kim et al.

(10) Patent No.: US 10,760,564 B2
(45) Date of Patent: Sep. 1, 2020

(54) RECIPROCATING COMPRESSOR HAVING A CONNECTOR

(71) Applicant: LG ELECTRONICS INC., Seoul (KR)

(72) Inventors: Dowan Kim, Seoul (KR); Jaeho Cho, Seoul (KR); Inyong Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 183 days.

(21) Appl. No.: 15/850,282

(22) Filed: Dec. 21, 2017

(65) Prior Publication Data

US 2018/0180037 A1 Jun. 28, 2018

(30) Foreign Application Priority Data

Dec. 28, 2016 (KR) ..... 10-2016-0180836

(51) Int. Cl.
*F04B 39/12* (2006.01)
*F04B 35/04* (2006.01)

(52) U.S. Cl.
CPC ..... *F04B 39/123* (2013.01); *F04B 35/045* (2013.01); *F04B 39/121* (2013.01)

(58) Field of Classification Search
CPC ..... F04B 35/00; F04B 35/04; F04B 39/00; F04B 39/12; F04B 39/121; F04B 39/123; F04B 53/16
USPC ..... 417/312, 410.1, 415, 437; 285/244, 243, 285/252, 305, 321
See application file for complete search history.

(56) References Cited

U.S. PATENT DOCUMENTS

| | | | | |
|---|---|---|---|---|
| 1,303,098 | A | 5/1919 | Merz | |
| 3,718,350 | A * | 2/1973 | Klein | F16L 37/088 285/39 |
| 3,871,800 | A | 3/1975 | Slayton | |
| 4,401,418 | A * | 8/1983 | Fritchman | F04B 39/0055 181/403 |
| 4,511,164 | A | 4/1985 | Orchard | |
| 6,155,610 | A | 12/2000 | Godeau et al. | |
| 8,628,118 | B2 | 1/2014 | Bobenhausen | |
| 2003/0052484 | A1 | 3/2003 | Rautureau | |
| 2006/0082145 | A1 * | 4/2006 | Steveley | F16L 37/144 285/305 |
| 2010/0226805 | A1 | 9/2010 | Kulmer | |

(Continued)

FOREIGN PATENT DOCUMENTS

| | | |
|---|---|---|
| EP | 2 207 962 | 4/2015 |
| KR | 10-2001-0029119 | 4/2001 |
| KR | 10-2003-0014199 | 2/2003 |

(Continued)

OTHER PUBLICATIONS

European Search Report dated Mar. 21, 2018 (17210702.1-1004).

(Continued)

*Primary Examiner* — Patrick Hamo
*Assistant Examiner* — Chirag Jariwala
(74) *Attorney, Agent, or Firm* — KED & Associates LLP

(57) ABSTRACT

A reciprocating compressor is provided. The reciprocating compressor may include a connector coupled to a discharge hose and a discharge pipe, a cutout formed in the connector or the discharge pipe, and a clamp inserted into the cutout. The connector and the discharge pipe may be supported by the clamp.

15 Claims, 13 Drawing Sheets

(56) References Cited

U.S. PATENT DOCUMENTS

2016/0131125 A1 5/2016 Yang et al.

FOREIGN PATENT DOCUMENTS

| | | |
|---|---|---|
| KR | 20-2009-0010124 | 10/2009 |
| KR | 10-2010-0085760 | 7/2010 |
| KR | 10-2013-0076308 | 7/2013 |
| KR | 10-2016-0055497 | 5/2016 |
| KR | 10-2016-0055530 | 5/2016 |
| WO | WO 2004/074684 | 9/2004 |

OTHER PUBLICATIONS

European Search Report dated Mar. 21, 2018 (1710704.7-1004).
Korean Office Action dated Dec. 28, 2017 (090936988).
Korean Office Action dated Dec. 28, 2017(090936450).
U.S. Appl. No. 15/850,084, filed Dec. 21, 2017, To Be Assigned.
U.S. Office Action issued in U.S. Appl. No. 15/850,084 dated Sep. 17, 2019.

* cited by examiner

RECIPROCATING COMPRESSOR HAVING A CONNECTOR

CROSS-REFERENCE TO RELATED APPLICATION(S)

This application claims priority under 35 U.S.C. 119 and 35 U.S.C. 365 to Korean Patent Application No. 10-2016-0180836 filed on Dec. 28, 2016 in Korea, the entire contents of which is hereby incorporated by reference in its entirety.

BACKGROUND

1. Field

A reciprocating compressor is disclosed herein.

2. Background

A reciprocating compressor refers to an apparatus that suctions in, compresses, and discharges a refrigerant through a reciprocating motion of a piston in a cylinder. The reciprocating compressor may be classified into a connection type reciprocating compressor and a vibration type reciprocating compressor according to a method of driving a piston. The connection type reciprocating compressor uses a method of compressing refrigerant through a reciprocating motion of a piston connected to a rotary shaft of a drive through a connecting rod in a cylinder, and the vibration type reciprocating compressor uses a method of compressing refrigerant through a reciprocating motion of a piston, which is connected to a movable element of a reciprocating motor to vibrate, in a cylinder.

The connection type reciprocating compressor is disclosed in Korean laid-open Patent Publication No. 10-2010-0085760 (hereinafter referred to as "Document 1"), which is hereby incorporated by reference. The disclosed connection type reciprocating compressor includes a housing shell forming a closed space, a drive unit or drive provided in the housing shell to provide a drive force, a compression unit connected to a rotary of the drive and configured to compress refrigerant through a reciprocating motion of a piston in a cylinder using the drive force from the drive, and a suction and discharge unit configured to suction in refrigerant and to discharge the compressed refrigerant through the reciprocating motion of the compression unit. The suction and discharge unit is connected with a discharge hose that discharges the compressed refrigerant and the discharge hose is coupled to a discharge pipe coupled to the shell of the compressor.

According to the conventional reciprocating compressor, as the discharge hose and the discharge pipe are not stably coupled, the discharge hose may be moved by pressure of the discharge refrigerant, and thus, brought into contact with the housing shell having a high temperature, thereby being damaged. In addition, as coupling between the discharge hose and the discharge pipe may be loosened, refrigerant may leak.

In order to solve this problem, a compressor including a connector that supports a discharge hose is disclosed in European Patent No. 2,207,962 (hereinafter, referred to as "Document 2"), which is hereby incorporated by reference. The connector is connected to a discharge hose and a discharge pipe. In addition, an end of the discharge pipe is deformed in a state in which the connector is inserted into the discharge pipe, thereby preventing the connector from being separated from the discharge pipe.

In Document 2, as the connector is made of plastic, the connector may be damaged when the end of the discharge pipe is deformed. In addition, a strength of a deformed portion of the discharge pipe may be reduced, thereby leaking refrigerant.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The following embodiments are provided as examples in order to help the full understanding. Accordingly, the embodiments are not limited to the following embodiments and may be variously embodied. For a better understanding, the figures are not necessarily to scale and sizes of some components are exaggerated.

Figure 1:
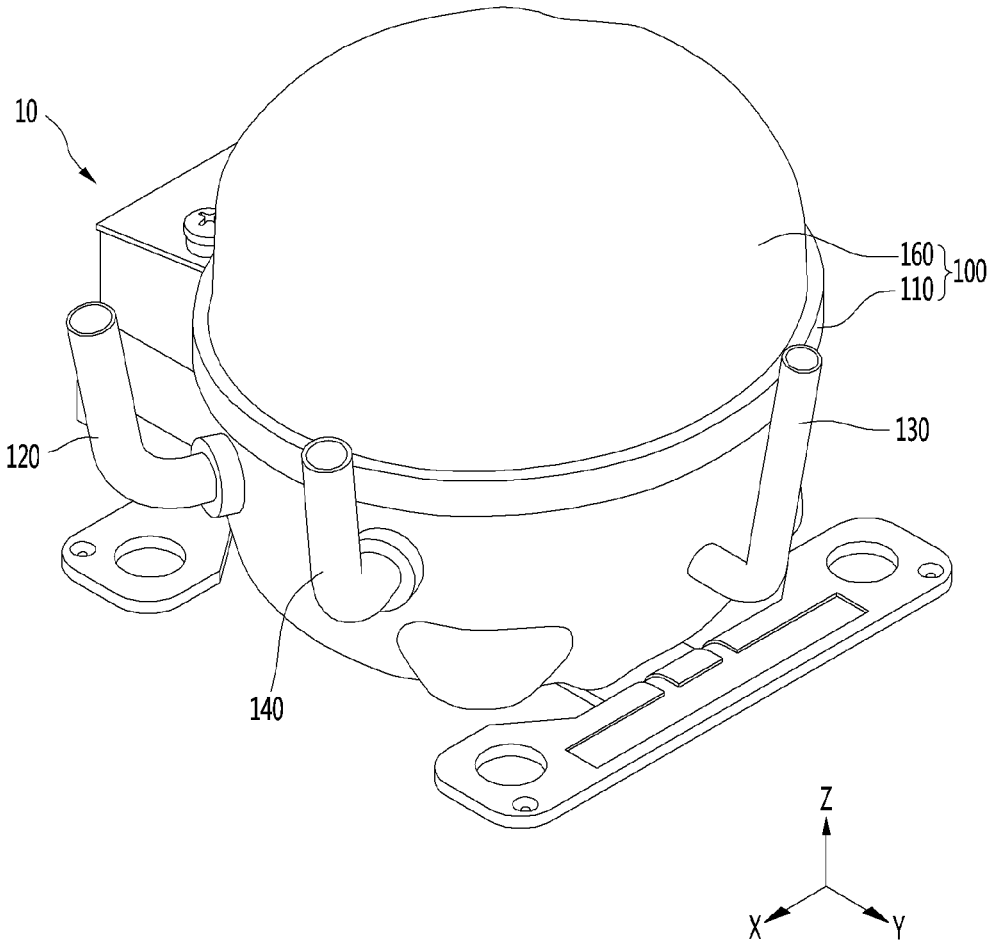
FIG. 1 is a perspective view showing a reciprocating compressor according to an embodiment.
Figure 2:
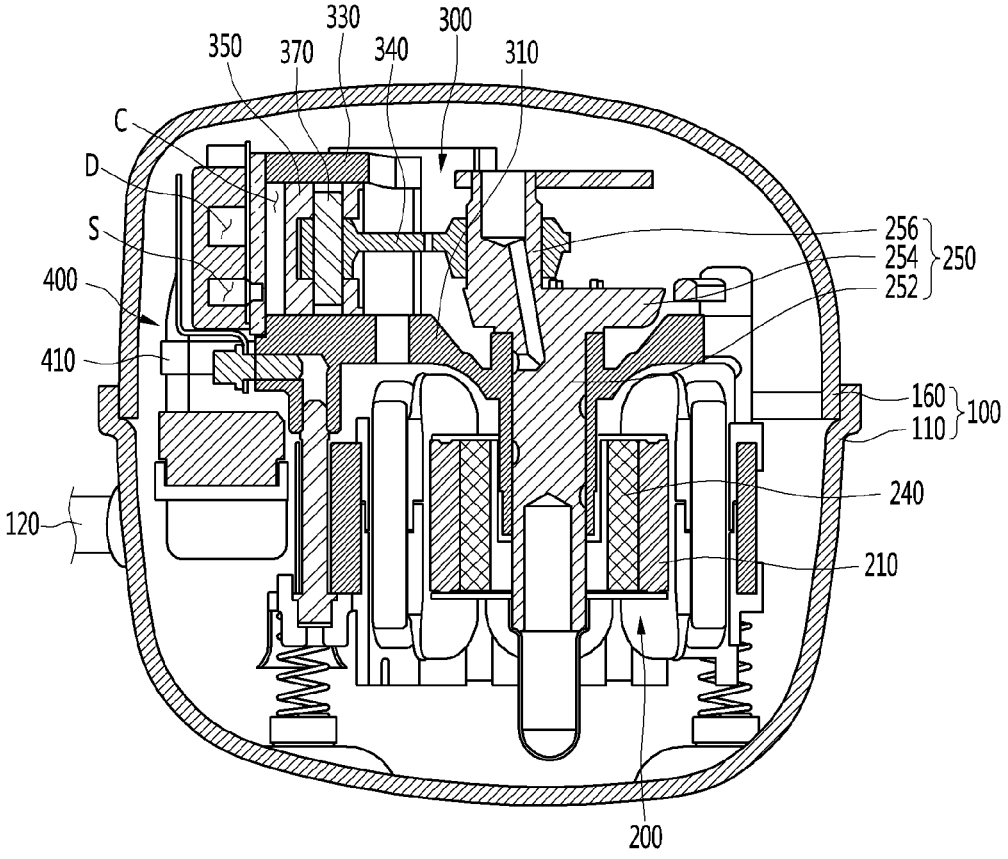
FIG. 2 is a cross-sectional view showing the reciprocating compressor according to the embodiment of FIG. 1.

FIG. 1 is a perspective view showing a reciprocating compressor according to an embodiment. FIG. 2 is a cross-sectional view showing the reciprocating compressor according to the embodiment of FIG. 1.

Referring to FIGS. 1 and 2, a reciprocating compressor 10 according to an embodiment may include a shell 100 forming an outer appearance thereof. A closed space may be formed in the shell 100 and various components of the compressor 10 may be received in the closed space. The shell 100 may be made, for example, of a metal.

The shell 100 may include a lower shell 110 and an upper shell 160 provided above the lower shell 110. More specifically, the lower shell 110 may have a substantially semi-spherical shape and form a reception space to receive various components, such as a drive unit or drive 200, a compression unit 300, and a suction and discharge unit 400 along with the upper shell 160. The lower shell 110 may be referred to as a "compressor body" and the upper shell 160 may be referred to as a "compressor cover".

The lower shell 110 may include a suction pipe 120, a discharge pipe 130, a process pipe 140, and a power supply (not shown). The suction pipe 120 may supply refrigerant into the shell 100 and penetrate through the lower shell 110. The suction pipe 120 may be mounted separately from or integrally with the lower shell 110.

The discharge pipe 130 may discharge compressed refrigerant from the shell 100 and penetrate through the lower shell 110. The discharge pipe 130 may be formed separately from or integrally with the lower shell 110.

The discharge pipe 130 may be connected with a discharge hose 510 of the suction and discharge unit 400. Refrigerant supplied into the suction pipe 120 and compressed by the compression unit 300 may be discharged to the discharge pipe 130 through the discharge hose 510 of the suction and discharge unit 400. The process pipe 140 may be provided to supply refrigerant into the shell 100 after closing an inside of the shell 100 and may penetrate through the lower shell 110.

The upper shell 160 may form the reception space along with the lower shell 110 and have an approximately semi-spherical shape like the lower shell 110. The upper shell 160 may close an upper side of the lower shell 110 to form a closed space therein.

The drive unit 200 may be provided in an internal space of the shell 100 to provide a drive force. The drive unit 200 may include a stator 210, a rotor 240, and a rotary shaft 250. The stator 210 may include a stator core, and a coil coupled to the stator core.

When power is applied to the coil, the coil generates an electromagnetic force to perform electromagnetic interaction along with the stator core and the rotor 240. Therefore, the drive unit 200 may generate a drive force for the reciprocating motion of the compression unit 300.

A magnet may be provided in the rotor 240 and rotatably provided in the coil. A rotational force generated by rotation of the rotor 240 acts as a drive force capable of driving the compression unit 200.

The rotary shaft 250 may be rotated along with the rotor 240 and may penetrate through the rotor 240 in an upward-and-downward direction. In addition, the rotary shaft 250 may be connected to a connecting rod 340 to transfer the rotational force generated by the rotor 240 to the compression unit 300.

More specifically, the rotary shaft 250 may include a base shaft 252, a rotational plate 254, and an eccentric shaft 256. The base shaft 252 may be mounted in the rotor 240 in the upward-and-downward direction (Z axis) or a longitudinal direction. When the rotor 240 rotates, the base shaft 252 may rotate along with the rotor 240. The rotational plate 254 may be mounted at one side of the base shaft 252 and may be rotatably mounted in a cylinder block 310.

The eccentric shaft 256 may protrude upward at a position located eccentrically from a center of an axis of the base shaft 252 and eccentrically rotate when the rotational plate 254 rotates. The connector rod 340 may be mounted on the eccentric shaft 256. According to eccentric rotation of the eccentric shaft 256, the connecting rod 340 may linearly reciprocate in a frontward-and-rearward direction (X axis).

The compression unit 300 may receive a drive force from the drive unit 200 and compress a refrigerant through a linear reciprocating motion. The compression unit 300 may include the cylinder block 310, the connecting rod 340, a piston 350, and a piston pin 370.

The cylinder block 310 may be provided above the rotor 240. In the cylinder block 310, a shaft opening 322, through which the rotary shaft 250 may penetrate, may be formed. A lower side of the cylinder block 310 may rotatably support the rotary plate 254.

A cylinder 330 may be provided in front of the cylinder block 310 to receive the piston 350. The piston 350 may reciprocate in the frontward-and-rearward direction and a compression space C, in which refrigerant may be compressed, may be formed in the cylinder 330.

The connecting rod 340 may transfer a drive force provided by the drive unit 200 to the piston 350 and switch rotational motion of the rotary shaft 250 into a linear reciprocation motion. More specifically, the connecting rod 340 may linearly reciprocate in the frontward-and-rearward direction upon rotation of the rotary shaft 250.

The piston 350 may compress the refrigerant and may be provided in the cylinder 330. In addition, the piston 350 may be connected to the connecting rod 340 and linearly reciprocate in the cylinder 330 according to the motion of the connecting rod 340. According to the reciprocating motion of the piston 350, refrigerant received through the suction pipe 120 may be compressed in the cylinder 330.

The piston pin 370 may couple the piston 350 and the connecting rod 340. More specifically, the piston pin 370 may penetrate through the piston 350 and the connecting rod 340 in the frontward-and-rearward direction to connect the piston 350 and the connecting rod 340.

The suction and discharge unit 400 may be configured to suction in refrigerant to be supplied to the compression unit 300 and to discharge the compressed refrigerant from the compression unit 300. The suction and discharge unit 400 may include a muffler assembly 410 and the discharge hose 510.

The muffler assembly 410 may transfer the refrigerant suctioned in from the suction pipe 120 into the cylinder 330 and transfer the refrigerant compressed in the compression space C of the cylinder 330 to the discharge pipe 130. In the muffler assembly 410, a suction space S that receives refrigerant suctioned in from the suction pipe 120 and a discharge space D that receives refrigerant compressed in the compression space C of the cylinder 330 may be provided.

More specifically, the refrigerant suctioned in from the suction pipe 120 may be supplied into the suction space S of a suction and discharge tank 426 through suction mufflers 430 and 420. In addition, the refrigerant compressed in the cylinder 330 may pass the discharge mufflers 425 and 438 through the discharge space D of the suction and discharge tank 426, thereby being discharged from the compressor 10 through the discharge hose 510.

The discharge hose 510 may transfer the compressed refrigerant received in the discharge space D to the discharge pipe 130 and be coupled to the muffler assembly 410. More specifically, one or a first side of the discharge hose 510 may be coupled to the muffler assembly 410 to communicate with the discharge space D and the other or a second side of the discharge hose 510 may be coupled to the discharge pipe 130 through a connector 530.

Figure 3:
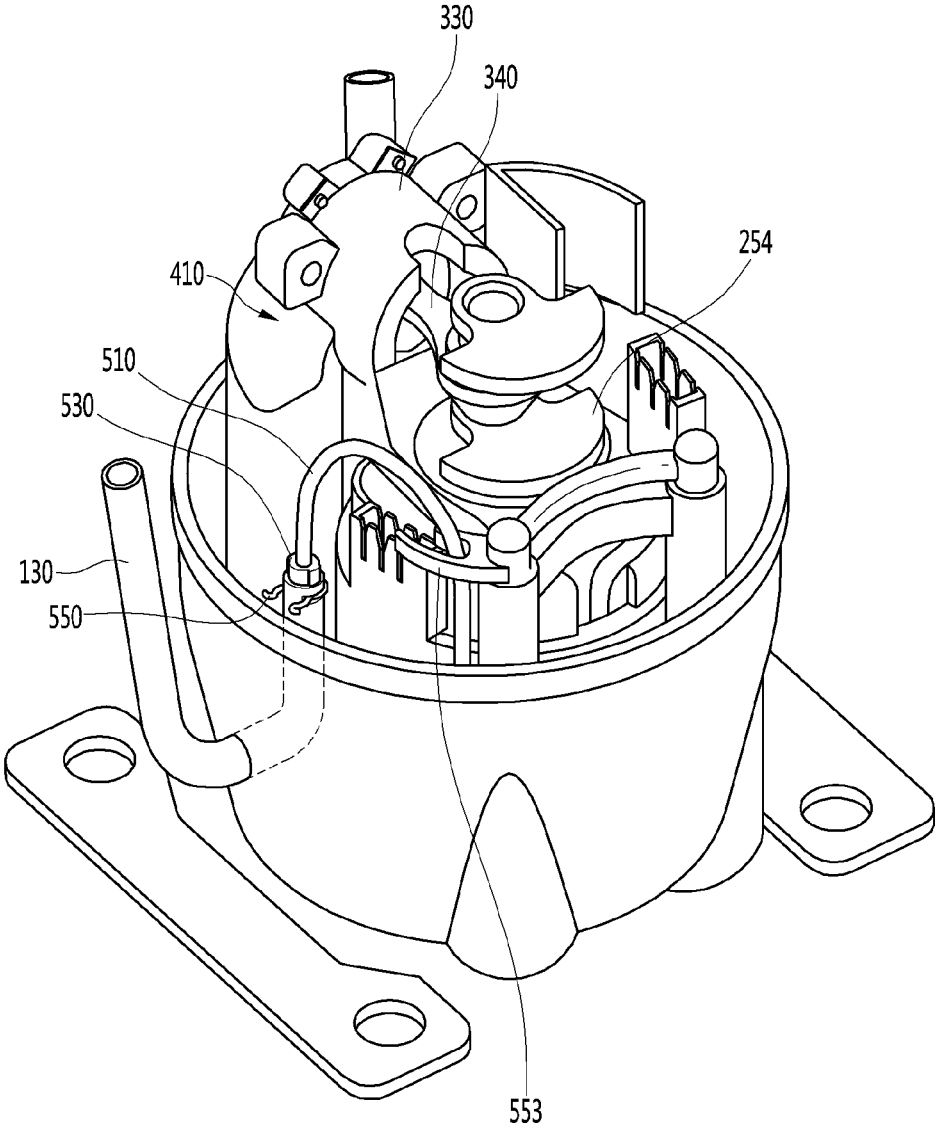
FIG. 3 is a diagram showing some components of the reciprocating compressor according to the embodiment of FIG. 1.
Figure 4:
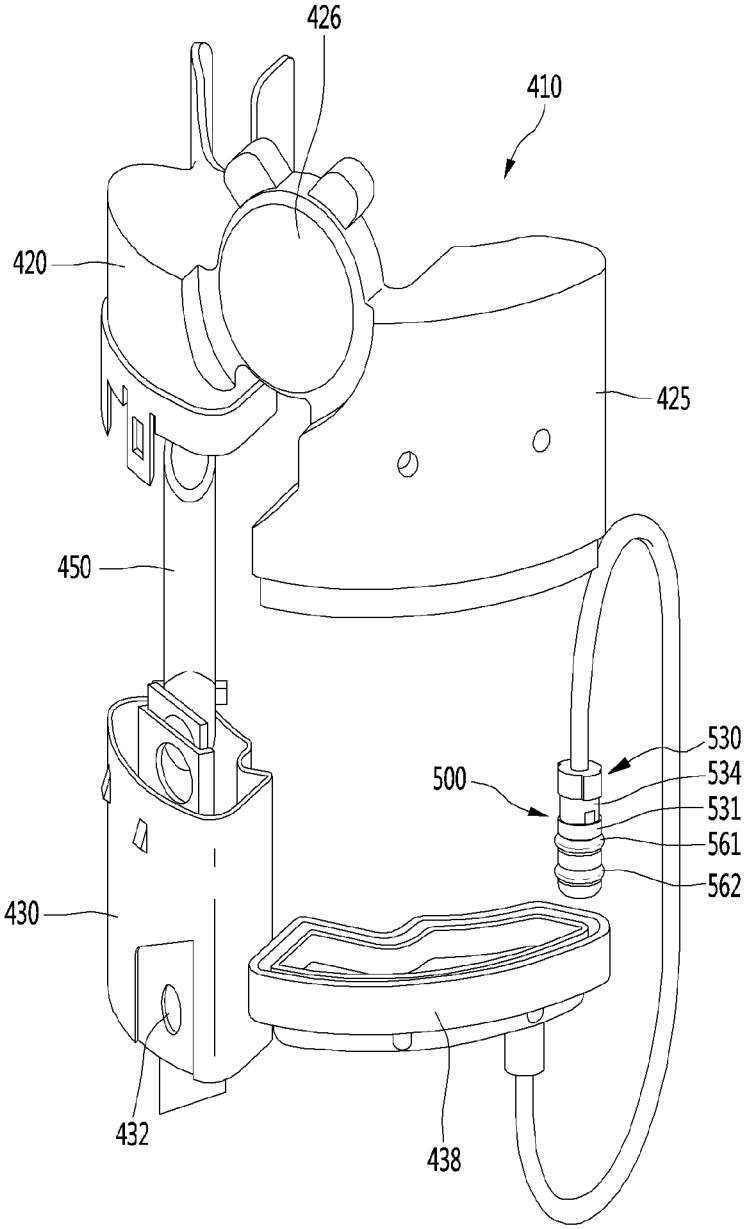
FIG. 4 is a front exploded perspective view showing a state of connecting a muffler assembly and a hose assembly according to the embodiment of FIG. 1.
Figure 5:
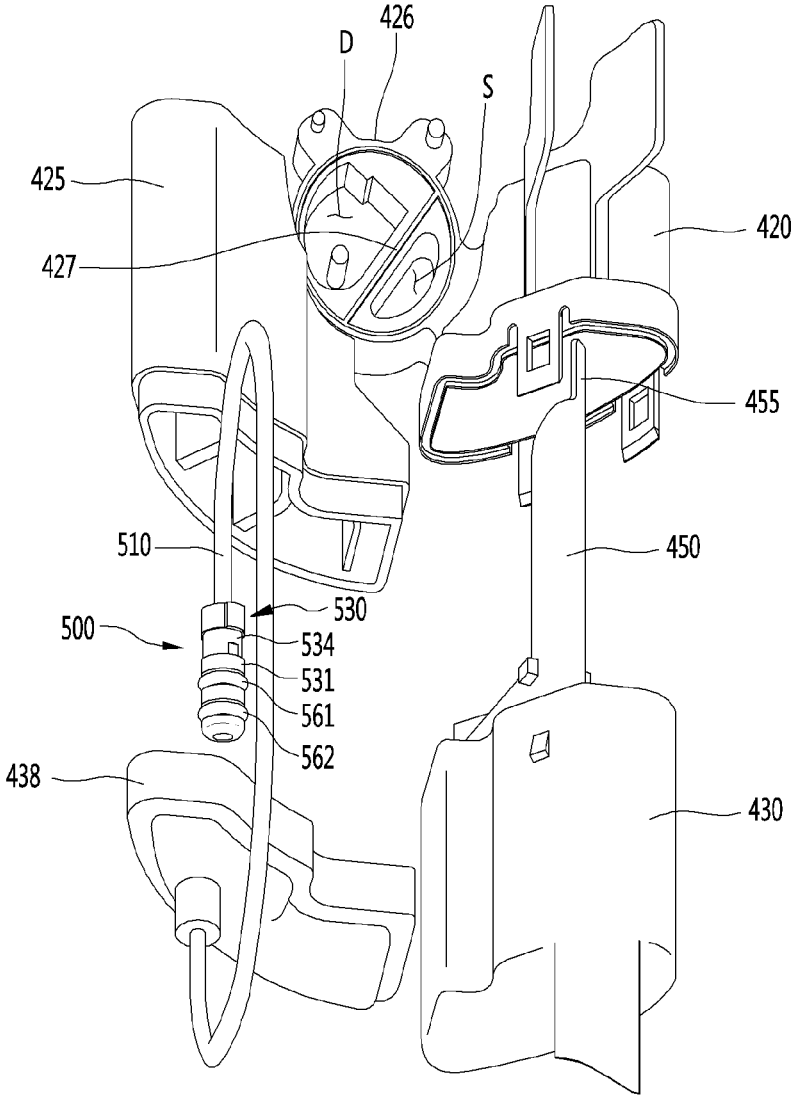
FIG. 5 is a rear exploded perspective view showing a state of connecting the muffler assembly and the hose assembly according to the embodiment of FIG. 1.

FIG. 3 is a diagram showing some components of the reciprocating compressor according to the embodiment of FIG. 1. FIG. 4 is a front exploded perspective view showing a state of connecting a muffler assembly and a hose assembly according to the embodiment of FIG. 1. FIG. 5 is a rear exploded perspective view showing a state of connecting the muffler assembly and the hose assembly according to the embodiment of FIG. 1.

Referring to FIGS. 3 to 5, the muffler assembly 410 according to the embodiment of FIG. 1 may include first assembling part or portion (suction muffler) 430, a second assembling part or portion (suction muffler) 420, a third assembling part or portion (discharge muffler) 425 and a fourth assembling part or portion (discharge muffler) 438. The first assembling portion 430 may include a suction hole 432 that communicates with the suction pipe 120. The suction hole 432 may be located adjacent to an inside of the lower shell 110, at a point at which the suction pipe 120 is coupled thereto. An internal pipe 450 may be mounted in the first assembling portion 430. For example, the internal pipe 450 may include an approximately cylindrical pipe.

The internal pipe 450 may extend from the first assembling portion 430 upward, thereby being coupled to the second assembling portion 420. The second assembling portion 420 may include a pipe fixing part or portion coupled with the internal pipe 450. The internal pipe 450 may include a second coupling part or portion 455 coupled to the pipe fixing part.

The second assembling portion 420 may be coupled to an upper side of the first assembling portion 430. At least a portion of the internal pipe 450 may be located inside the first assembling portion 430 and another portion thereof may be located inside the second assembling portion 420.

When the first assembling portion 430 and the second assembling portion 420 are coupled, a suction flow channel in which the refrigerant supplied to the compressor 10 may flow toward the cylinder 330 may be formed in the first and second assembling portions 430 and 420. Accordingly, the first and second assembling portions 430 and 420 may be collectively referred to as a "suction muffler".

The third assembling portion 425 may be spaced apart from one side of the second assembling portion 420. In addition, the suction and discharge tank 426 forming the suction space S and the discharge space D may be mounted between the second assembling portion 420 and the third assembling portion 425. The suction and discharge tank 426 may include a partition 427 that partitions an internal space of the suction and discharge tank 426 into the suction space S and the discharge space D. In addition, a valve assembly (not shown) may be provided at one side of the suction and discharge tank 426. The valve assembly may include a suction valve (not shown) that opens and closes the suction space S, and a discharge valve (not shown) that opens and closes the discharge space D.

The fourth assembling portion 438 may be coupled to a lower side of the third assembling portion 425. When the third assembling portion 425 and the fourth assembling portion 438 are coupled, a discharge flow channel in which the refrigerant discharged from the cylinder 330 flows toward the discharge pipe 130 is formed in the first and second assembling portion 425 and 450. Accordingly, the third and fourth assembling portion 425 and 450 may be collectively referred to as a "discharge muffler".

The fourth assembling portion 438 may be coupled with the discharge hose 510. The discharge hose 510 may transfer the refrigerant in the fourth assembling portion 438 to the discharge pipe 130. One or a first side of the discharge hose 510 may be coupled to the fourth assembling portion 438 and the other or a second side thereof may be coupled to the discharge pipe 130 through the connector 530. The discharge hose 510 may extend from the fourth assembling portion 438 toward the discharge pipe 130 and may be configured to be curved or bent at least once to be provided in the restricted internal space of the shell 100.

A substantially central part or portion of the discharge hose 510 may be supported by a hose fixing part or portion 553. The hose fixing portion 553 may be configured to clamp the discharge hose 510. For example, the hose fixing portion 553 may have a shape of tongs and may be disposed to surround at least a portion of an outer circumferential surface of the discharge hose 510. The discharge hose 510 may be located to be spaced apart from an inner side surface of the shell 100 by the hose fixing portion 553.

The discharge pipe 130 may penetrate through the lower shell 110 to extend to the inside of the lower shell 110 and the discharge hose 510 may be connected to the discharge pipe 130. For example, the discharge pipe 130 may penetrate through the lower shell 110 and may be bent and extended upward. By this configuration, in a state in which the discharge pipe 130 is assembled in the shell 100, the connector 530 or the discharge hose 510 may be easily assembled in the discharge pipe 130. That is, although the internal space of the shell 100 is small and crowded due to the components of the compressor, it may be easy to assemble the connector 530 or the discharge hose 510 using tools, for example.

The discharge hose 510 may be made, for example, of rubber or plastic, and the discharge pipe 130 may be made, for example, of metal, such as copper (Cu). Hereinafter, a configuration of a hose assembly including the discharge hose 510 will be described.

Figure 6:
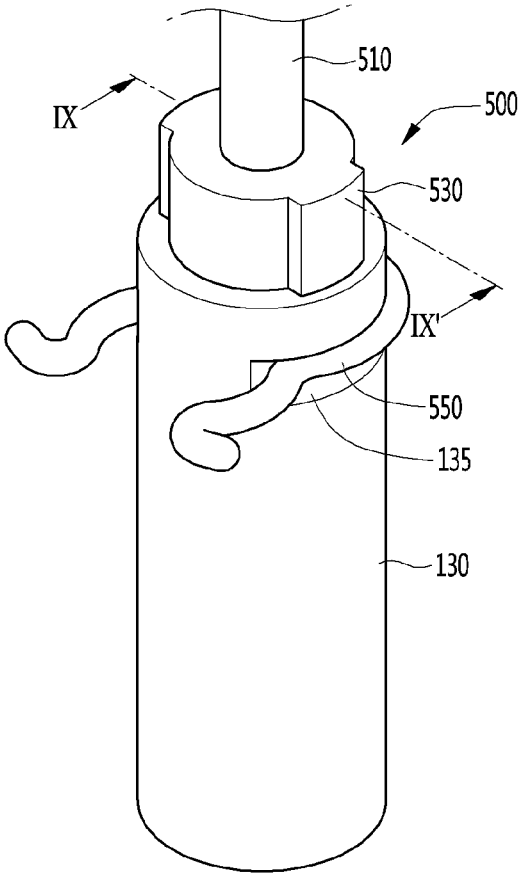
FIG. 6 is a perspective view showing a configuration of a discharge pipe and the hose assembly according to the embodiment of FIG. 1.
Figure 7:
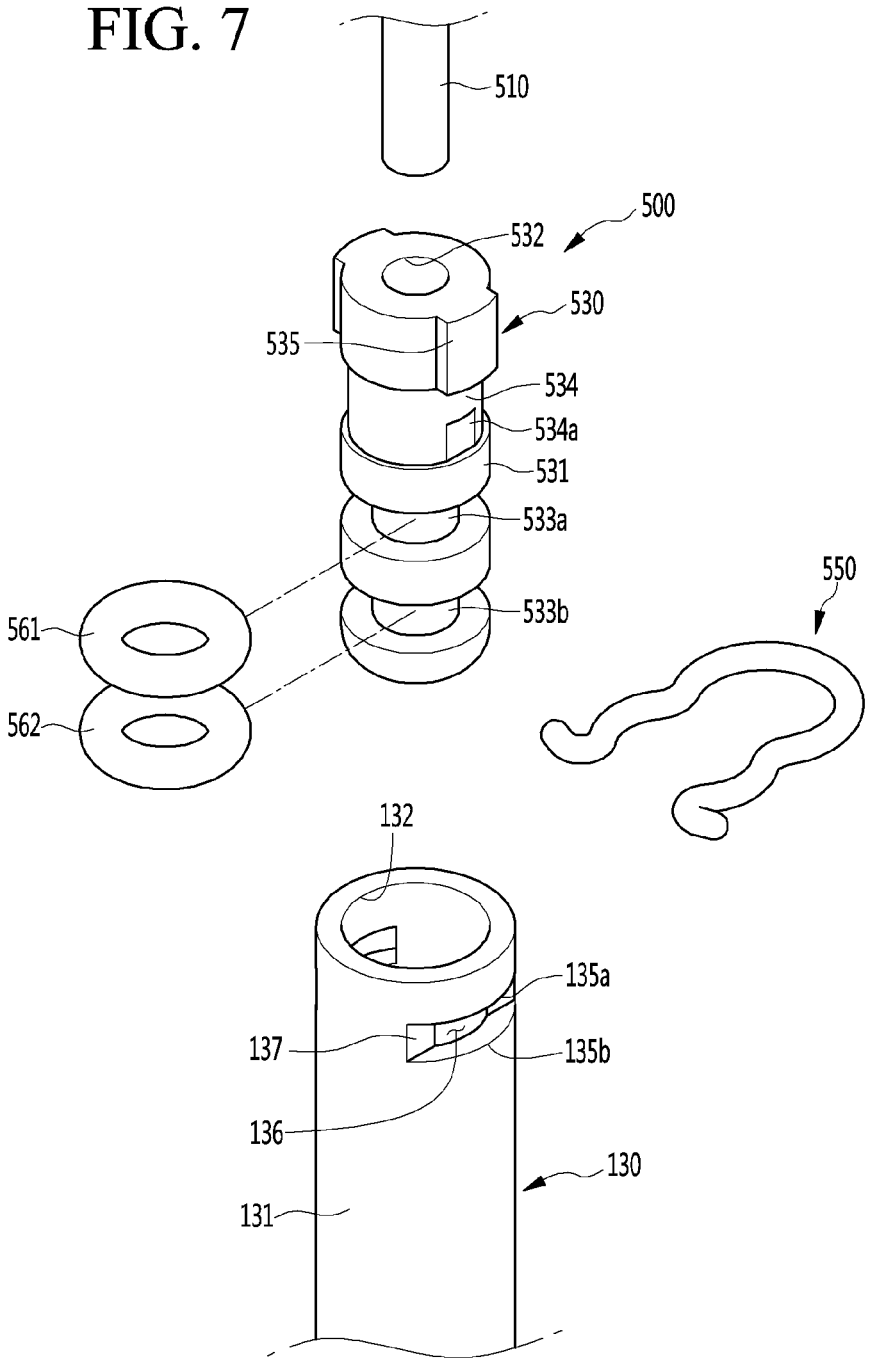
FIG. 7 is an exploded perspective view showing the configuration of the discharge pipe and the hose assembly according to the embodiment of FIG. 1.
Figure 8:
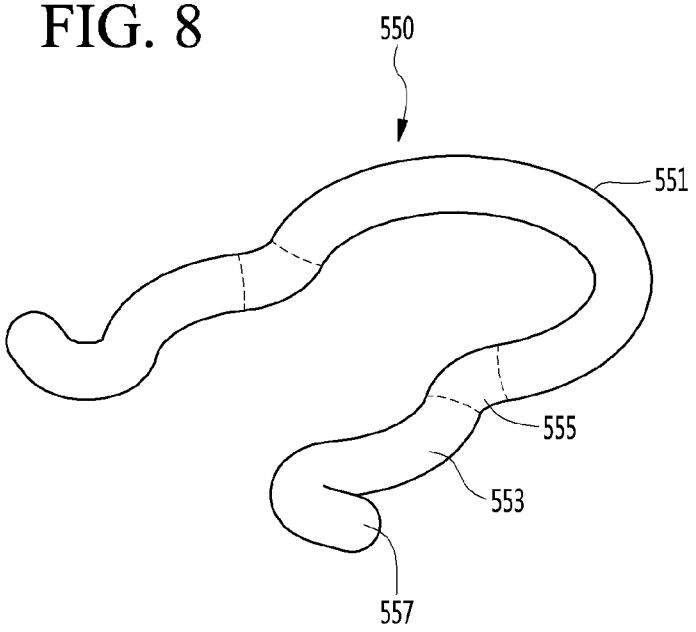
FIG. 8 is a view showing a configuration of a clamp according to the embodiment of FIG. 1.
Figure 9:
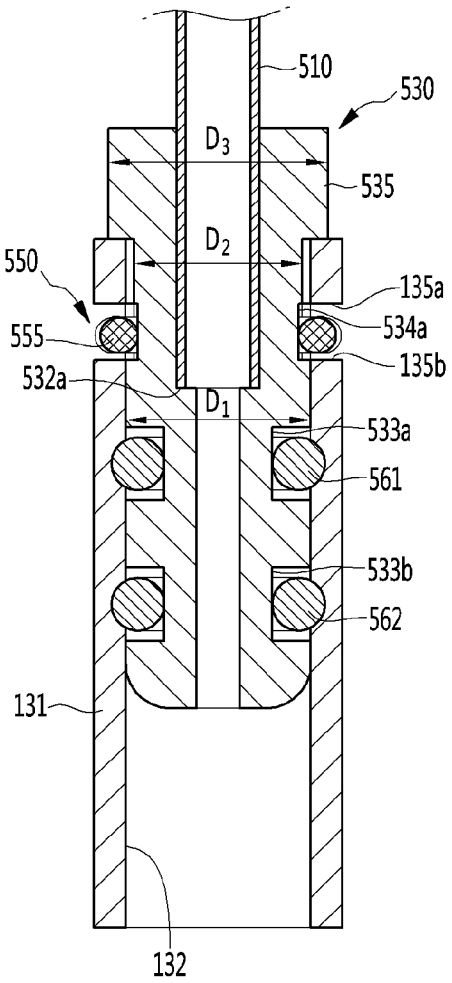
FIG. 9 is a cross-sectional view taken along line IX-IXI' of FIG. 6.

FIG. 6 is a perspective view showing a configuration of a discharge pipe and the hose assembly according to the embodiment of FIG. 1. FIG. 7 is an exploded perspective view showing the configuration of the discharge pipe and the hose assembly according to the embodiment of FIG. 1. FIG. 8 is a view showing a configuration of a clamp according to the embodiment of FIG. 1. FIG. 9 is a cross-sectional view taken along line IX-IX' of FIG. 6.

Referring to FIGS. 6 to 9, the hose assembly 500 according to this embodiment may include the discharge hose 510 connected to the discharge mufflers 425 and 438 to guide discharge of refrigerant and the connector 530 connected to the discharge hose 510 to connect the discharge hose 510 with the discharge pipe 130. The hose assembly 500 may further include a clamp 550 that supports the connector 530 and the discharge pipe 130.

The connector 530 may be made, for example, of plastic or metal. In addition, the connector 530 may have a substantially hollow cylindrical shape.

The connector 530 may include a connector body 531 having first and second grooves 533*a* and 533*b*. The connector body 531 may have a first outer diameter D1. The first and second grooves 533*a* and 533*b* may be formed in a circumferential direction and disposed to be spaced apart from each other in the upward-and-downward direction.

The first and second grooves 533*a* and 533*b* may include the first groove 533*a* formed in an upper portion of the connector body 531 and the second groove 533*b* formed in a lower portion of the connector body 531. A ring member 560 (561, 562) may be mounted in each of the first and second grooves 533*a* and 533*b*. More specifically, the ring member may include a first ring member 561 mounted in the groove 533*a* and a second ring member 562 mounted in the second groove 533*b*. The first and second ring members 561 and 562 may be made, for example, of rubber or synthetic resin.

The connector body 531 may be inserted into the discharge pipe 130 in a state in which the first and second ring members 561 and 562 are coupled to an outer circumferential surface of the connector body 531. The first and second ring members 561 and 562 may be brought into contact with or adhered to an inner surface of the discharge pipe 130.

That is, the first and second ring members 561 and 562 may be interposed between the outer circumferential surface of the connector 530 and an inner circumferential surface of the discharge pipe 130, the connector 530 may be stably supported inside the discharge pipe 130. If a plurality of ring members is provided, such an effect may be further improved.

The connector 530 may further include a first clamp supporting part or support 534 that extends from the connector body 531 and supported by the clamp 550. The first clamp support 534 may be disposed between the connector body 531 and a pipe lock 535 and inserted into the discharge pipe 130. The first clamp support 534 may extend to an inside of an upper end of the discharge pipe 130.

The first clamp support 534 may be configured to have a second outer diameter D2. The second outer diameter D2 may be less than the first outer diameter D1. Accordingly, the first clamp support 534 may not be adhered to the inner circumferential surface of the connector body 531.

The first clamp support 534 may include a supporting surface 534*a* pressurized by the clamp 550. The supporting surface 534*a* may be located inside a penetration hole 136 and aligned with the penetration hole 136. The supporting surface 534*a* may form at least a portion of the first clamp support 534 and configure a flat surface to be easily pressed by the clamp 550. For example, the clamp 550 may contact the supporting surface 534*a* to pressurize the first clamp support 534 inward in a radial direction.

Directions will be defined hereinafter. A direction in which the discharge hose 510 and the discharge pipe 130 are aligned with each other is defined as an axial direction or an upward-and-downward (longitudinal) direction and a direction perpendicular to the axial direction is defined as a radial direction or a lateral direction.

The connector 530 may further include the pipe lock 535 that extends from the first clamp support 534 upward and supported by an end of the discharge pipe 130. A third outer diameter D3 of the pipe lock 535 may be greater than the first outer diameter D1. A lower end of the pipe lock 535 may be supported by an upper surface of the discharge pipe 130. The pipe lock 535 may function as a stopper that restricts an insertion depth of the connector 530. By the pipe lock 535, the connector 530 may be suppressed from being further inserted into the discharge pipe 130.

A first insertion hole 532, into which the discharge hose 510 may be inserted, may be formed in an upper surface of the pipe lock 535. The first insertion hole 532 may extend from an upper surface to a lower surface of the connector 530 and form a refrigerant flow channel for transferring refrigerant of the discharge hose 510 to the discharge pipe 130.

The discharge hose 510 may be inserted into the connector 530 through the first insertion hole 532. A stepped part or step 532*a* may be formed on an inner circumferential surface of the connector 530 defining the first insertion hole 532. A lower end of the discharge hose 510 may be supported by the step 532*a*. By the step 532*a*, a depth of the discharge hose 510 inserted into the connector 530 may be restricted to a set or predetermined depth. The predetermined depth may be understood as a distance from the first insertion hole 532 to the step 532*a*.

The discharge pipe 130 may include a pipe body 131 having a hollow cylindrical shape. A second insertion hole 132, into which at least a portion of the connector 530 may be inserted, may be formed in the pipe body 131. The connector 530 may be inserted through the second insertion hole 132 to extend downward. The first and second ring members 561 and 562 may be provided between the outer circumferential surface of the connector 530 and the inner circumferential surface of the discharge pipe 130, thereby obtaining a sealing effect for maintaining coupling between the connector 530 and the discharge pipe 130 and preventing refrigerant leakage.

A cutting part or cutout 135, into which the clamp 550 may be inserted, may be formed in the pipe body 131. The cutout 135 may be formed by recessing at least a portion of the pipe body 131. The pipe body 131 may include an upper step 135*a* and a lower step 135*b*.

The cutout 135 may be defined by the upper step 135*a* and the lower step 135*b*. The upper step 135*a* may form an upper end of the cutout 135 and the lower step 135*b* may form a lower end of the cutout 135. That is, the cutout 135 may be understood as a recessed part or recess between the upper step 135*a* and the lower step 135*b*. A plurality of cutouts 135 and upper and lower steps 135*a* and 135*b* may be provided at both sides of the pipe body 131.

The clamp 550 may be located between the upper step 135*a* and the lower step 135*b*. The upper step 135*a* and the lower step 135*b* may function as locking steps that prevent the clamp 550 from moving upward or downward to escape from the discharge pipe 130.

The pipe body 131 may include a second clamp supporting part or support 137 supported by the clamp 550. The second clamp support 137 may be understood as a portion of the cutout 135. In addition, the second clamp support 137 may configure a flat surface to be easily pressed by the clamp 550. For example, the clamp 550 may be brought into contact with at least a portion of the second clamp support 137 to pressurize the second clamp support 137 inward in the radial direction.

The pipe body 131 may further include the penetration hole 136, through which at least a portion of an outer circumferential surface of the pipe body 131 may penetrate. The penetration hole 136 may be formed between the upper step 135*a* and the lower step 135*b*. A plurality of penetration holes 136 may be formed at both sides of the pipe body 131.

The supporting surface 534*a* of the connector 530 may be externally exposed through the penetration hole 136. The clamp 550 may be in contact with the supporting surface 534*a* through the penetration hole 136. For example, the clamp 550 may pressurize the supporting surface 534*a* inward in the radial direction. Both sides of the clamp 550 may be in contact with the supporting surface 534*a* through the plurality of penetration holes 136.

In summary, the clamp 550 may support the supporting surface 534*a* exposed through the penetration hole 136 and the second clamp support 137. As the clamp 550 is locked in the cutout 135 of the discharge pipe 130, that is, between the upper step 135*a* and the lower step 135*b*, upward or downward movement may be restricted. Accordingly, the connector 530 may be stably supported by the clamp 550 in the discharge pipe 130.

A configuration of the clamp 550 will be described hereinafter. The clamp 550 may be elastically deformed.

More specifically, the clamp 550 may include pipe supporting parts or supports 551 and 553 that support the outer circumferential surface of the pipe body 131. The pipe supports 551 and 553 may include first pipe support 551 that supports a portion of the outer circumferential surface of the pipe body 131 and second pipe support 553 that supports another portion of the outer circumferential surface of the pipe body 131.

The first and second pipe supports 551 and 553 may be rounded with a predetermined curvature in correspondence with a curvature of the outer circumferential surface of the pipe body 131. A plurality of second pipe supports 553 may be provided at both sides of the first pipe support 551.

The clamp 550 may further include a connector supporting part or support 555 provided between the first and second pipe supports 551 and 553 and supporting the supporting surface 534*a*. At least a portion of the connector support 555 may support the second clamp support 137. A plurality of connector supports 555 may be provided between the first pipe support 551 and the plurality of second pipe supports 553.

The clamp 550 may further include a clamp manipulation part or portion 557 that forms both sides of the clamp 550 and capable of being grasped by a user for manipulation. When the two clamp manipulation portions 557 are manipulated to be separated from each other, the clamp 550 may be deformed to be separated from the cutout 635. In contrast, when the clamp manipulation portions 557 are released, the clamp 550 may be contracted by a restoring force to be located in the cutout 135. The clamp 550 may support the supporting surface 534*a* or the second clamp support 137.

By such a configuration, the discharge pipe 130 and the connector 530 may be stably coupled by the clamp 550 and the discharge hose 510 may be supported by the connector 530 to communicate with the discharge pipe 130. As a result, it is possible to prevent the discharge hose 510 from being shaken, and thus, to prevent the discharge hose 510 from being damaged by contact with the shell 100 having a high temperature. In addition, it is possible to prevent refrigerant from leaking at a coupling position as coupling between the discharge hose 510 and the discharge pipe 130 is loosened.

Refrigerant flowing in the discharge hose 510 may be transferred to the discharge pipe 130 through an internal space of the connector 530. That is, the space of the inner circumferential side of the connector 530 may form a discharge flow channel.

Hereinafter, another embodiment will be described. This embodiment is different from the previous embodiment in only some components and a difference between the embodiments will be focused upon. For the same components as the previous embodiment, refer to the description and reference numerals of the previous embodiment. Repetitive disclosure has been omitted.

Figure 10:
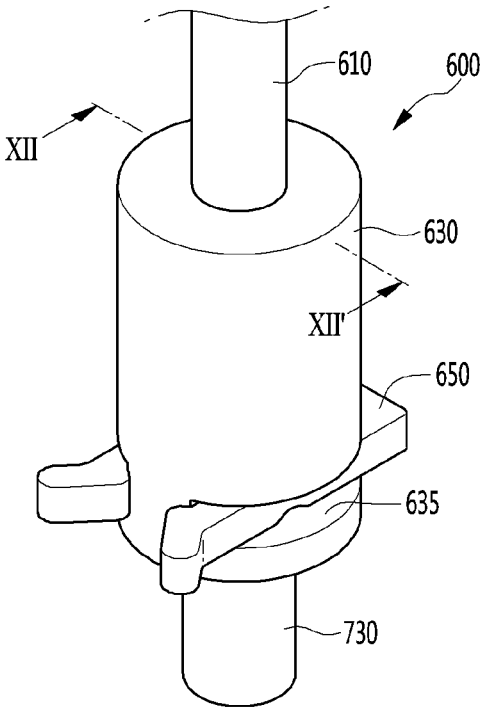
FIG. 10 is a perspective view showing a configuration of a discharge pipe and a hose assembly according to another embodiment.
Figure 11:
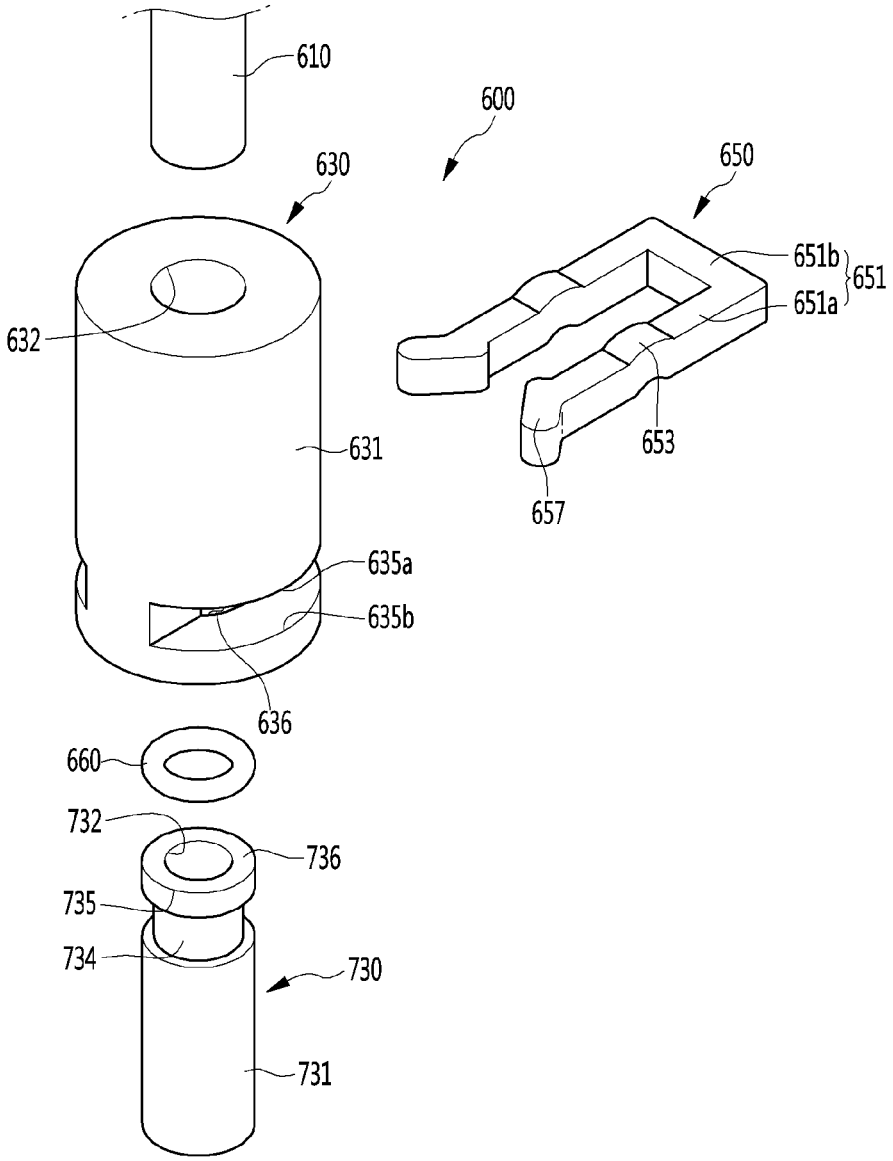
FIG. 11 is an exploded perspective view showing the configuration of a discharge pipe and a hose assembly according to the embodiment of FIG. 10.
Figure 12:
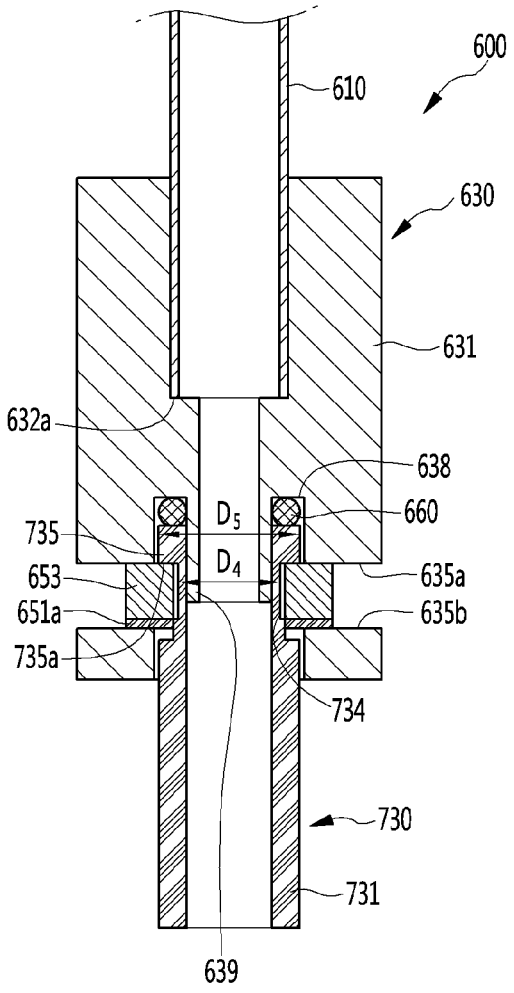
FIG. 12 is a cross-sectional view taken along line XII-XII' of FIG. 10.

FIG. 10 is a perspective view showing a configuration of a discharge pipe and a hose assembly according to another embodiment. FIG. 11 is an exploded perspective view showing the configuration of the discharge pipe and the hose assembly according to the embodiment of FIG. 10. FIG. 12 is a cross-sectional view taken along line XII-XIII' of FIG. 10.

Referring to FIGS. 10 to 12, the hose assembly 600 according to this embodiment may include a discharge hose 610 connected to discharge mufflers 425 and 438 to guide discharge of refrigerant and a connector 630 coupled to the discharge hose 610 to connect the discharge hose 610 with a discharge pipe 730. The hose assembly 600 may further include a clamp 650 inserted into cutout 635 of the connector 630 to be coupled to the discharge pipe 130. More specifically, the connector 630 may be made, for example, of plastic or metal.

The connector 630 may include a connector body 631 having a substantially hollow cylindrical shape. The connector body 631 may include a first insertion hole 632 that extends from an upper surface of the connector body 631 downward to have the discharge hose 610 inserted therein. The first insertion hole 632 may be formed to penetrate through the connector body 631 from the upper surface to a lower surface thereof.

The discharge hose 610 may be inserted into the connector 630 through the first insertion hole 632. A stepped part or step 632*a* may be provided on an inner circumferential surface of the connector 630 defining the first insertion hole 632. A lower end of the discharge hose 610 may be supported by the step 632*a*. By the step 632*a*, a depth of the connector 630 inserted into the discharge hose 610 may be restricted to a set or predetermined depth. The predetermined depth may be understood as a distance from the first insertion hole 632 to the step 632*a*.

The cutout 635, into which the clamp 650 may be inserted, may be formed in the connector body 631. The cutout 635 may be formed by recessing at least a portion of the connector body 631, and may be formed at a lower portion of the connector body 631. The connector body 631 may include an upper step 635*a* and a lower step 635*b*.

The cutout 635 may be defined by the upper step 635*a* and the lower step 635*b*. The upper step 635*a* may form an upper end of the cutout 635, and the lower step 635*b* may form a lower end of the cutout 635. That is, the cutout 635 may be understood as a recessed part or recess between the upper step 635*a* and the lower step 635*b*. In addition, a plurality of cutouts 635 and upper and lower steps 635*a* and 635*b* may be provided at both sides of the connector body 631.

The clamp 650 may be located between the upper step 635*a* and the lower step 635*b*. The upper step 635*a* and the lower step 635*b* may function as a locking step that prevents the clamp 550 from moving upward or downward to be separated from the connector 630.

The cutout 635 may further include a penetration hole 636 formed in at least a portion of the outer circumferential surface of the connector body 631. The penetration hole 136 may be formed between the upper step 635*a* and the lower step 635*b*. In addition, a plurality of penetration holes 636 may be formed at both sides of the pipe body 131. At least a portion of the discharge pipe 730 may be externally exposed through the penetration hole 636.

The discharge pipe 730 may include a pipe body 731 having a substantially hollow cylindrical shape. The discharge pipe 730 may further include a clamp supporting part or support 734 that extends from the pipe body 731 upward and located inside the penetration hole 635. The clamp support 734 may be externally exposed through the penetration hole 636 and may be understood as a component supported by the clamp 650. The clamp support 734 may form at least a portion of an outer circumferential surface of the discharge pipe 730 and have a first outer diameter D4. In addition, the clamp support 734 may be located inside the penetration hole 636 and may be aligned with the penetration hole 636.

The discharge pipe 730 may further include a connector insertion part or portion 735 that extends from the clamp support 734 upward and inserted into the connector 630. The connection insertion portion 735 may have a second outer diameter D5. The second outer diameter D5 may be greater than the first outer diameter D4. By such a difference between the outer diameters, a supporting step 735*a* may be formed on a bottom of the connector insertion portion 735 and the projection 653 of the clamp 650 may be supported by the supporting step 735*a*.

The connector insertion portion 735 may include a ring seating part or seat 736 on which the ring member 660 may be seated. The ring seat 736 may form an upper surface of the connector insertion portion 735.

A second insertion hole 732, into which at least a portion of the connector 630 may be inserted, may be formed in the connector insertion portion 735. The second insertion hole 732 may be formed to penetrate the discharge pipe 730 from an upper surface to a lower surface thereof. The second insertion hole 732 may form a refrigerant flow channel.

A pipe insertion part or portion 639 of the connector 630 may be inserted into the second insertion hole 732. The pipe insertion portion 639 may protrude from a lower portion of the connector body 631 downward and may be inserted into the second insertion hole 732.

The connector body 631 may further include a connector recessed part or recess 638 formed by recessing a lower surface of the connector body 631 upward. The pipe insertion portion 639 may be understood as a component that extends from the connector recess 638 downward.

The ring member 660 and the connector insertion portion 735 may be inserted into the connector recess 638. More specifically, the ring member 660 may be inserted into the connector recess 638 and then the connector insertion portion 735 may be inserted. Accordingly, the ring member 660 may be seated in the ring seat 736 of the connector insertion portion 735 and may be interposed in a space between the connector recess 638 and the ring seat 735 to be adhered to the connector 630 and the discharge pipe 730.

The clamp 650 may be elastically deformed. More specifically, the clamp 650 may include a clamp body 651 that supports the outer circumferential surface of the connector body 631. The clamp body 651 may include two first parts or portions 651*a*inserted into two cutting parts or cutouts 635 and a second part or portion 651*b* that connects the two first portions 651*a*. By the two first portions 651*a* and the second portion 651*b*, the clamp body 651 may have a shape of "⊂".

The clamp 650 may further include a projection 653 that protrudes from the clamp body 651. More specifically, the projection 653 may protrude from the first portion 651 upward. The first portion 651*a* may be placed on the lower step 635*b*, and the projection 653 may be supported by the upper step 635*a*. For example, the first portion 651*a* and the projection 653 may be in contact with the lower step 635*b* and the upper step 635*a*, respectively. In addition, the projection 653 may support the supporting step 735 of the connector insertion portion 735.

By such a configuration, the projection 653 serves to push the supporting step 735*a* up in a state in which the clamp 650 is inserted into the cutout 635. Accordingly, the discharge pipe 730 may pressurize the ring member 660. In addition, as the projection 653 is supported by the upper step 635*a*, the supporting step 735*a* and the upper step 635*a* may configure a supporting surface that contacts the projection 635. In addition, the supporting surface may form one plane.

The clamp 650 may further include clamp manipulation parts or portions 657 provided at both sides of the clamp body 651 and capable of being grasped by a user for manipulation. When the two clamp manipulation portions 657 are manipulated to be separated from each other, the clamp 650 may be deformed and separated from the cutout 635. In contrast, when the clamp manipulation portions 657 are released, the clamp 650 may be closed by a restoring force and be located in the cutout 635.

By such a configuration, the discharge pipe 730 and the connector 630 may be stably coupled by the clamp 650, and the discharge hose 610 may be supported by the connector 630 to communicate with the discharge pipe 730. As a result, the discharge hose 610 may be prevented from being shaken, and thus, the discharge hose 610 may be prevented from being damaged by contact with the shell 100 having a high temperature. In addition, it is possible to prevent refrigerant from leaking at a coupled portion as coupling between the discharge hose 610 and the discharge pipe 730 is loosened.

Figure 13:
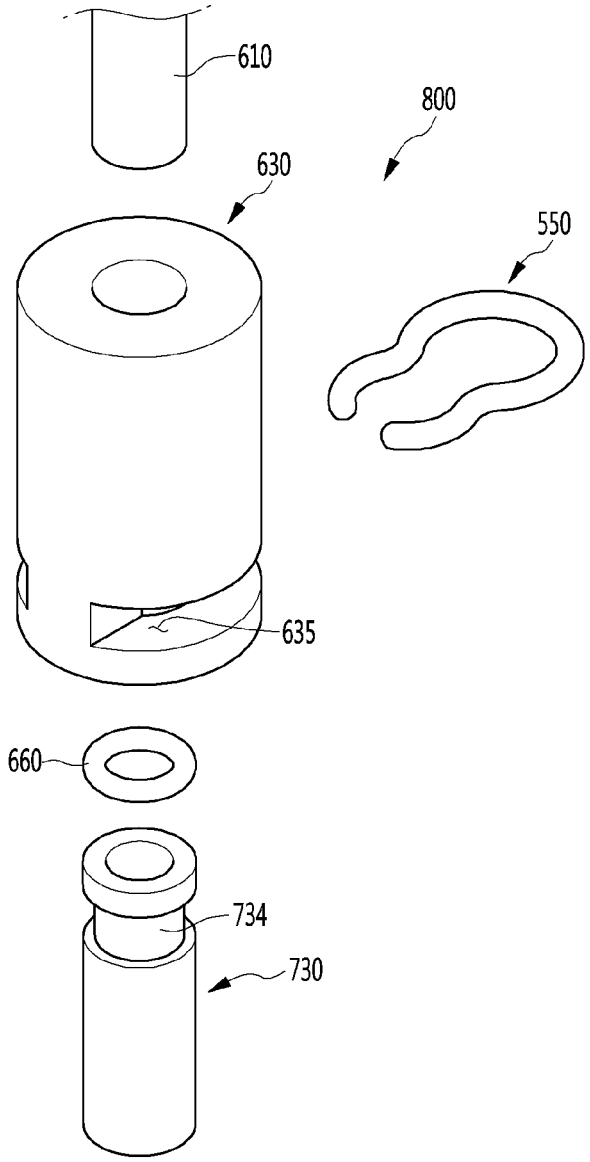
FIG. 13 is an exploded perspective view showing a state of coupling a discharging pipe and a hose assembly according to another embodiment.

FIG. 13 is an exploded perspective view showing a state of coupling a discharge pipe and a hose assembly according to another embodiment. Referring to FIG. 13, the hose assembly 800 according to this embodiment may include discharge hose 610 and connector 630 coupled to the discharge hose 610. In addition, the hose assembly 800 may include a ring member 660 interposed between the connector 630 and the discharge pipe 730 to increase a coupling force of the connector 630 and the discharge pipe 730. For the discharge pipe 730, the discharge hose 610, the connector 630, and the ring member 660, refer to the description of the previous embodiment.

The hose assembly 800 may further include clamp 550 inserted into cutout 635 of the connector 630 and supported by the clamp support 734 of the discharge pipe 730. For the clamp 550, refer to the description of the clamp of the first embodiment.

In summary, the hose assembly 800 according to this embodiment includes the clamp 650 of the hose assembly according to the previous embodiment replaced by the clamp 550 of the first embodiment. As the clamp 550 may be inserted into the cutout 630 of the connector 630, the effects of this embodiment may be similar to the effects of the previous embodiment.

According to embodiments disclosed herein, as the discharge hose is stably coupled to the discharge pipe by the connector, the discharge hose may be prevented from being moved when refrigerant flows, and thus, the discharge hose may be prevented from being damaged by contact with the shell wall having a high temperature, thereby preventing refrigerant from leaking. Further, as the clamp for coupling the connector with the discharge pipe is included and the clamp supports the connector and the discharge pipe, it is possible to stably couple the connector with the discharge pipe. Furthermore, as a process (hereinafter, a "caulking process") of deforming an end of the discharge pipe after inserting the connector into the discharge pipe may be omitted, it is possible to prevent the connector from being damaged upon the caulking process and prevent refrigerant from leaking due to a decrease in strength of the discharge pipe.

In addition, as a ring member is provided between the connector and the discharge pipe and the ring member is adhered between the outer circumferential surface of the connector and the inner circumferential surface of the discharge pipe, the connector and the discharge pipe may be stably coupled. Accordingly, it is possible to prevent the discharge hose from moving.

As the discharging pipe penetrates through the shell and is bent upward in the shell, it is possible to easily assemble the connector or the discharge hose in the discharge pipe in a state in which the discharge pipe is assembled in the shell. That is, the internal space of the shell is small due to components of the compressor, the connector or the discharge hose may be easily assembled using tools, for example.

Therefore, embodiments disclosed herein been developed in view of discussed problems, and provide a reciprocating compressor in which a discharge hose and a discharge pipe are stably coupled. Embodiments disclosed herein further provide a reciprocating compressor for guiding coupling between a discharge hose and a discharge pipe using a separate member without using a caulking process in order to prevent a connector from being damaged.

Embodiments disclosed herein also provide a reciprocating compressor including a ring member that guides stable coupling between a connector and a discharge pipe when the connector is assembled in the discharge pipe. Embodiments disclosed herein provide a reciprocating compressor having a structure in which a discharge pipe is bent in a shell such that a connector or a discharge hose is easily assembled in the discharge pipe.

Embodiments disclosed herein provide a reciprocating compressor that may include a connector coupled to a discharge hose and a discharge pipe, a cutting part or cutout formed in the connector or the discharge pipe, and a clamp inserted into the cutting part. The connector and the discharge pipe may be supported by the clamp. A first insertion hole provided in the connector and having the discharge hose inserted thereinto and a second insertion hole provided in the discharge pipe and having at least a part or portion of the connector inserted thereinto may also be included.

The connector may include a stepped part or step formed on an inner circumferential surface of the connector defining the first insertion hole and configured to support an end of the discharge hose, thereby restricting an insertion depth of the discharge hose. The cutting part may be formed in the discharge pipe, and the discharge pipe may include an upper step and a lower step defining the cutting part.

The discharging pipe may further include a penetration hole formed in at least a part or portion of an outer circumferential surface of the discharge pipe. The penetration hole may be formed between the upper step and the lower step. The connector may include a supporting surface located inside the penetration hole, and the clamp may support the supporting surface through the penetration hole, thereby stably coupling the connector with the discharge pipe.

A ring member provided on an outer circumferential surface of the connector and contacting an inner circumferential surface of the discharge pipe may be further included. The connector may include a connector body having the ring member mounted thereon and inserted into the discharge pipe, a clamp supporting part or support that extends from the connector body and having the supporting surface, and a pipe locking part or lock that extends from the clamp supporting part and supported by an end of the discharge pipe. The clamp may include a plurality of rounded pipe supporting parts or supports that support an outer circumferential surface of the discharge pipe and a connector supporting part or support provided between the plurality of pipe supporting parts and supporting the supporting surface, such that the clamp may easily support the connector.

The cutting part may be formed in the connector. The connector may include an upper step and a lower step defining the cutting part.

A connector recessed part or recess formed in one surface of the connector and a connector insertion part or portion provided in the discharge pipe and inserted into the connector recessed part may be further included. A ring seating part or seat formed in one surface of the connector insertion part and a ring member interposed between the ring seating part and the connector recessed part and contacting the connector and the discharge pipe may be further included.

The connector may further include a pipe insertion part or portion that extends from the connector recessed part and inserted into the second insertion hole. The clamp may include a clamp body that supports an outer circumferential surface of the connector body and inserted into the cutting part to be placed on the lower step, and a projection that protrudes from the clamp body and supported by the upper step.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating compressor, comprising:

a shell provided with a discharge pipe;

a cylinder provided inside the shell and having a compression chamber;

a discharge hose configured to discharge a refrigerant compressed in the compression chamber; and a connector coupled to the discharge hose and the discharge pipe, the connector including:

a connector body including an upper step and a lower step;

a penetration hole formed in the connector body, the penetration hole being located between the upper step and the lower step; and a clamp coupled to the connector, wherein the clamp is configured to support the connector and the discharge pipe, wherein the discharge pipe is configured to be inserted into the connector body, the discharge pipe including a clamp support configured to be disposed adjacent to the penetration hole, and wherein the clamp is located in the penetration hole to be locked by the upper step and the lower step and contact the clamp support, wherein a first insertion hole is provided in the connector and the discharge hose is inserted into the first insertion hole, and wherein a second insertion hole is provided in the discharge pipe and at least a portion of the connector is inserted into the second insertion hole.

2. The reciprocating compressor according to claim 1, wherein the clamp support is externally exposed through the penetration hole.

3. The reciprocating compressor according to claim 1, wherein the connector body includes:

an inner circumferential surface defining the first insertion hole, and a step formed on the inner circumferential surface and configured to support an end of the discharge hose.

4. The reciprocating compressor according to claim 1, wherein the clamp support forms a portion of an outer circumferential surface of the discharge pipe.

5. The reciprocating compressor according to claim 1, wherein the portion of the connector inserted into the second insertion hole of the discharge pipe protrudes from a lower portion of the connector body.

6. The reciprocating compressor according to claim 1, the connector is made of plastic or metal.

7. The reciprocating compressor according to claim 1, wherein the discharge pipe includes a pipe body having a substantially hollow cylindrical shape, and wherein the clamp support extends from the pipe body and is located inside of the penetration hole.

8. The reciprocating compressor according to claim 1, further comprising:

a connector recess formed in one surface of the connector; and a connector insertion portion provided in the discharge pipe and inserted into the connector recess.

9. The reciprocating compressor according to claim 8, further comprising:

a ring seat formed in one surface of the connector insertion portion; and a ring member interposed between the ring seat and the connector recess and contacting the connector and the discharge pipe.

10. The reciprocating compressor according to claim 8, wherein an outer diameter of the clamp support is less than an outer diameter of the connection insertion portion.

11. The reciprocating compressor according to claim 10, further comprising:

a supporting step formed on the connector insertion portion; and a projection provided at the clamp and supported by the supporting step.

12. The reciprocating compressor according to claim 1, wherein the upper step and the lower step are provided at both sides of the connector body.

13. The reciprocating compressor according to claim 12, wherein the clamp includes a clamp body, wherein the clamp body includes:

two first portions inserted between the upper step and the lower step provided at both sides of the connector body, respectively;

a second portion that connects the two first portions of the clamp; and two clamp manipulation portions provided at both sides of the clamp body, respectively.

14. The reciprocating compressor according to claim 13, wherein each of the two clamp manipulation portions extends from an end portion of the respective two first portions of clamp body, and wherein when the two clamp manipulation portions are manipulated to be separated from each other, the clamp is deformed and separated from the connector, and when the two clamp manipulation portions are released, the clamp is coupled to the connector by a restoring force of the clamp.

15. The reciprocating compressor according to claim 13, wherein the clamp body has a shape of "I".

* * * * *